US005433231A

United States Patent [19]

Weaver

[11] Patent Number: 5,433,231

[45] Date of Patent: Jul. 18, 1995

[54] REMOVABLE SCRAP TRAP FOR DISHWASHERS

[76] Inventor: Myron G. Weaver, 240 Mohns Hill Rd., Reinholds, Pa. 17569

[21] Appl. No.: 250,822

[22] Filed: May 31, 1994

[51] Int. Cl.[6] ..... B08B 3/02

[52] U.S. Cl. ..... 134/111; 134/201; 210/232

[58] Field of Search ..... 210/232, 448, 452, 222; 4/652; 134/14, 201

[56] References Cited

U.S. PATENT DOCUMENTS

| | | | |
|---|---|---|---|
| 1,633,283 | 6/1927 | Osborne | 134/111 |
| 1,638,549 | 8/1927 | Onmart | 134/14 |
| 3,679,505 | 7/1972 | Hinderaker et al. . | |
| 3,831,759 | 8/1974 | Gelman et al. | 210/232 |
| 3,912,473 | 10/1975 | Wilkins . | |
| 3,960,728 | 6/1976 | Otzen | 134/111 X |
| 4,468,321 | 8/1984 | St. John | 210/232 |
| 4,961,849 | 10/1990 | Hull et al. | 210/232 |

*Primary Examiner*—Frankie L. Stinson

[57] ABSTRACT

A new and improved removable scrap trap for dishwashers comprising a cylindrical screened container having a closed bottom and an open top and an intermediate sidewall therebetween. The intermediate extent has a lower end and a rigid upper end. A circular flange is secured to the rigid upper end. The circular flange has an inner edge, an outer edge, and an intermediate extent therebetween. A circular recess is formed upwardly within the intermediate extent of the circular flange. The cylindrical screened container is made of a nylon mesh. The nylon mesh functions to prevent food particles and other objects from falling into a drain valve. A magnetic element is secured within the circular recess formed within the intermediate extent of the circular flange of the cylindrical screened container. The magnetic element functions to seal the circular screened container to the floor of a dishwasher. A handle is secured to the rigid upper end of the intermediate sidewall of the cylindrical screened container. The handle functions to allow the cylindrical screened container to be removed from the water passageway leading to the pump.

1 Claim, 3 Drawing Sheets

REMOVABLE SCRAP TRAP FOR DISHWASHERS

BACKGROUND OF THE INVENTION

1. Field of the Invention

The present invention relates to removable scrap traps for dishwashers and more particularly pertains to stopping food and other objects from clogging a drain valve, pump and washer arms.

2. Description of the Prior Art

The use of filters is known in the prior art. More specifically, filters heretofore devised and utilized for the purpose of catching food particles are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,165,4333 to Meyers a soil separator for a domestic dishwasher.

U.S. Pat. No. 5,143,306 to Nilsson discloses a waste disintegrating device for a dishwasher.

U.S. Pat. No. Des. 293,016 to Fisher discloses the design of a filter for a dishwasher.

U.S. Pat. No. 3,807,419 to Cushing et al. discloses a dishwasher having means for collecting and removing food soil.

U.S. Pat. No. 3,585,128 to Hoffman discloses a prewash scrap basket for a dishwasher.

In this respect, the removable scrap trap for dishwashers according to the present invention substantially departs from the conventional concepts and designs of the prior art, and in doing so provides an apparatus primarily developed for the purpose of stopping food and other objects from clogging the drain valve, pump and washer arms.

Therefore, it can be appreciated that there exists a continuing need for new and improved removable scrap traps for dishwashers which can be used for stopping food and other objects from clogging the drain valve, pump and washer arms. In this regard, the present invention substantially fulfills this need.

SUMMARY OF THE INVENTION

In view of the foregoing disadvantages inherent in the known types of filters now present in the prior art, the present invention provides an improved removable scrap trap for dishwashers. As such, the general purpose of the present invention, which will be described subsequently in greater detail, is to provide a new and improved removable scrap trap for dishwashers and method which has all the advantages of the prior art and none of the disadvantages.

To attain this, the present invention essentially comprises a removable scrap trap for dishwashers comprised of a cylindrical screened container having a closed bottom and an open top and an intermediate sidewall therebetween. The intermediate sidewall has a lower end and a rigid upper end. A circular flange is secured to the rigid upper end. The circular flange has an inner edge, an outer edge, and an intermediate extent therebetween. A circular recess is formed upwardly within the intermediate extent of the circular flange. The cylindrical screened container is made of a nylon mesh with a pore size of between 0.05 millimeters to 5.0 millimeters. The nylon mesh functions to prevent food particles and other objects from entering into a drain valve, pump or washer arms. A flexible magnetic element is secured within the circular recess formed within the intermediate extent of the circular flange of the cylindrical screened container. The flexible magnetic element functions to seal the circular screened container to the floor of a dishwasher. A plastic handle is secured to the rigid upper end of the intermediate sidewall of the cylindrical screened container. The handle functions to allow the cylindrical screened container to be removed from the water passageway leading to the pump.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved removable scrap trap for dishwashers which has all the advantages of the prior art filters and none of the disadvantages.

It is another object of the present invention to provide a new and improved removable scrap trap for dishwashers which may be easily and efficiently manufactured and marketed.

It is further object of the present invention to provide a new and improved removable scrap trap for dishwashers which is of durable and reliable construction.

An even further object of the present invention is to provide a new and improved removable scrap trap for dishwashers which is susceptible of a low cost of manufacture with regard to both materials and labor, and which accordingly is then susceptible of low prices of sale to the consuming public, thereby making such removable scrap trap for dishwashers economically available to the buying public.

Still yet another object of the present invention is to provide a new and improved removable scrap trap for dishwashers which provides in the apparatuses and methods of the prior art some of the advantages thereof, while simultaneously overcoming some of the disadvantages normally associated therewith.

Even still another object of the present invention is to stop food and other objects from clogging the drain valve, pump, or washer arms.

Lastly, it is an object of the present invention to provide new and improved removable scrap trap for dishwashers comprising a cylindrical screened container having a closed bottom and an open top and an intermediate sidewall therebetween. The intermediate sidewall has a lower end and a rigid upper end. A circular flange is secured to the rigid upper end. The circular flange has an inner edge, an outer edge, and an intermediate extent therebetween. A circular recess is formed upwardly within the intermediate extent of the circular flange. The cylindrical screened container is made of a nylon mesh. The nylon mesh functions to prevent food particles and other objects from entering into the drain valve, pump or washer arms. A magnetic element is secured within the circular recess formed within the intermediate extent of the circular flange of the cylindrical screened container. The magnetic element functions to seal the circular screened container to the floor of a dishwasher. A handle is secured to the rigid upper end of the intermediate sidewall of the cylindrical screened container. The handle functions to allow the cylindrical screened container to be removed from the water passageway leading to the pump.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
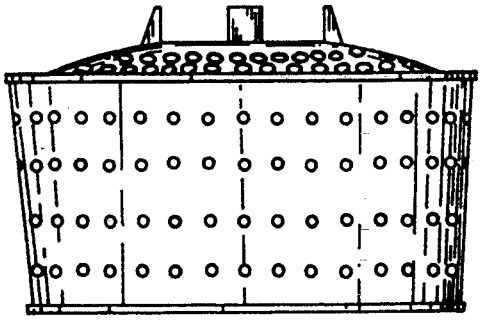
FIG. 1 PRIOR ART
FIG. 1 is a front elevational view of the prior art filter for a dishwasher.
Figure 2:
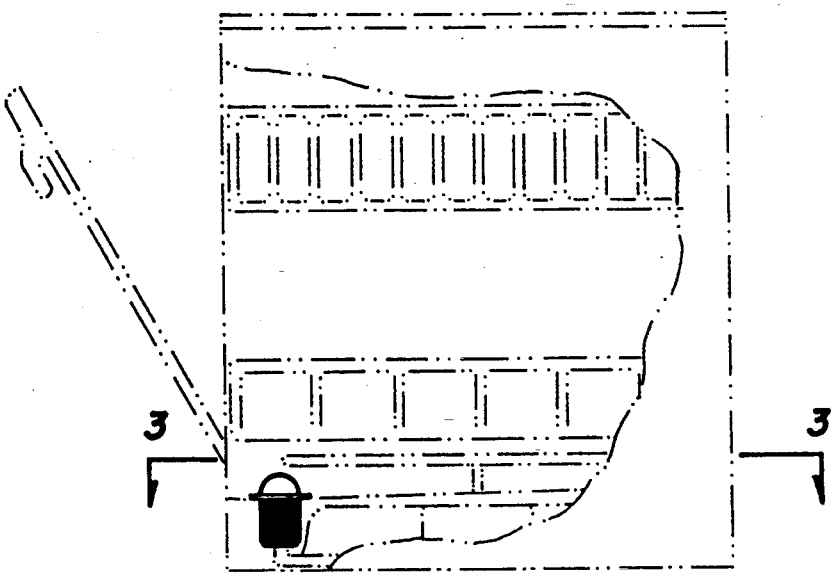
FIG. 2 is a side view of the preferred embodiment of the present invention constructed in accordance with the principles of the present invention as it is utilized within a dishwasher.
Figure 3:
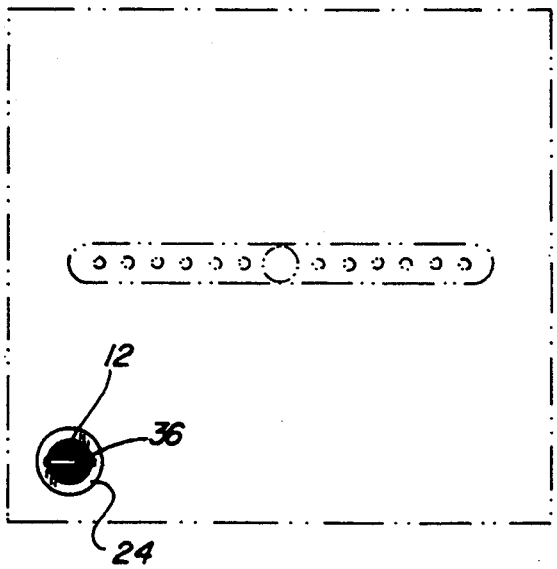
FIG. 3 is a top view of the present invention as seen along line 3—3 of FIG. 2.
Figure 4:
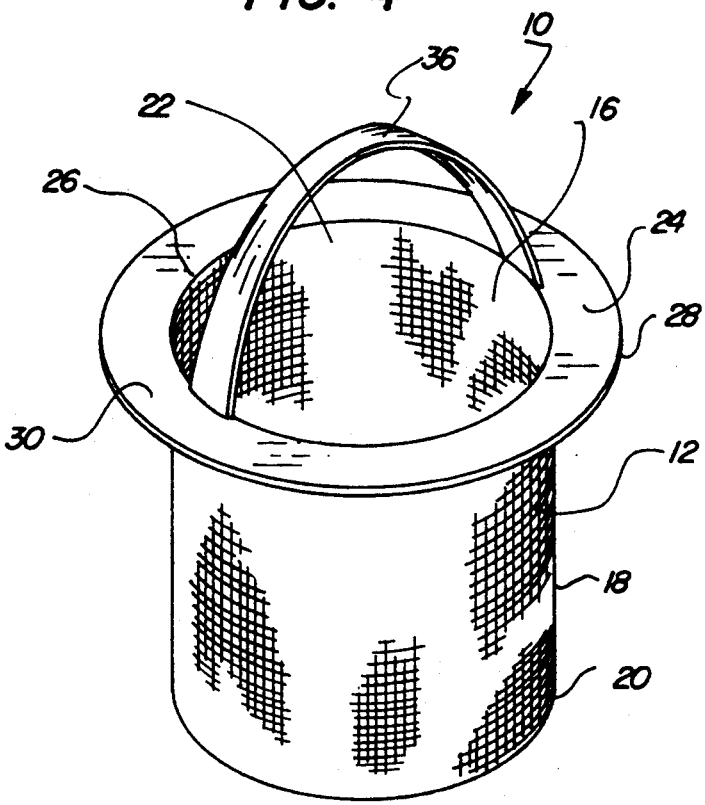
FIG. 4 is a perspective view of the preferred embodiment of the removable scrap trap for dishwashers constructed in accordance with the principles of the present invention.
Figure 5:
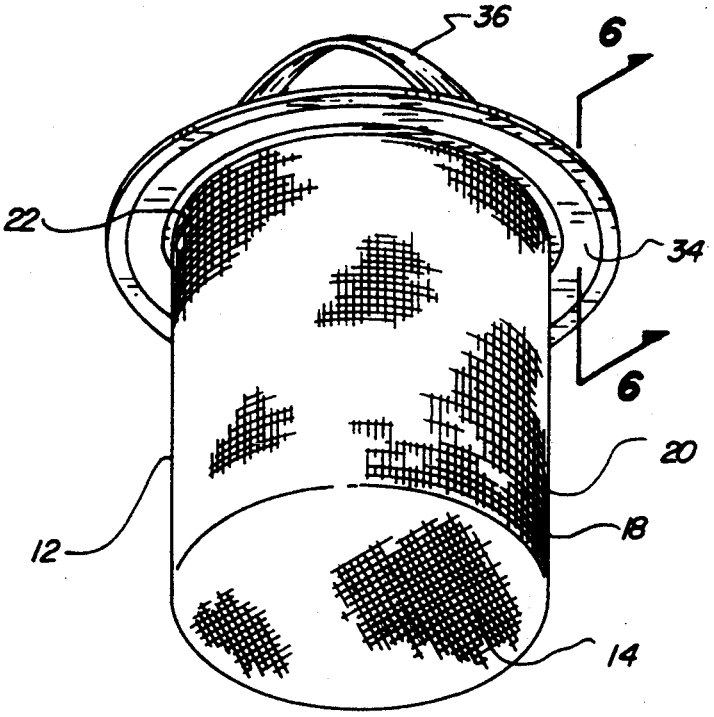
FIG. 5 is an elevated perspective view of the present invention.
Figure 6:
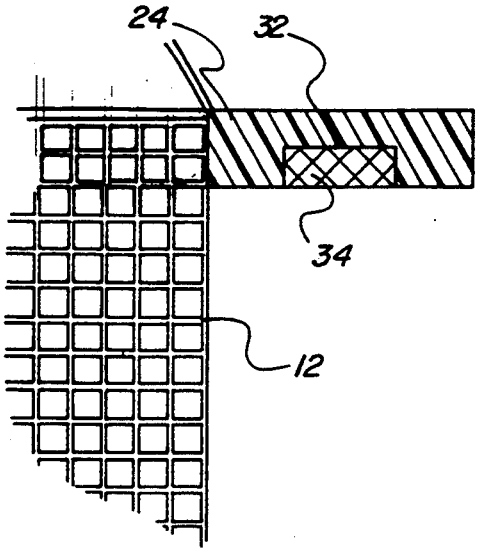
FIG. 6 is a side view of the present invention as seen along line 6—6 of FIG. 5.

With reference now to the drawings, and in particular to FIG. 1 thereof, the preferred embodiment of the new and improved removable scrap trap for dishwashers embodying the principles and concepts of the present invention and generally designated by the reference numeral 10 will be described.

More specifically, it will be noted in the various Figures that the device is designed to improve the reliability of automatic dishwashers. The device eliminates the need to rinse dishes before washing them and allowing the dishwasher to run more smoothly with fewer breakdowns. In its broadest context, the device contains a cylindrical screened container, a magnetic element, and a handle.

A cylindrical screened container 12 has a closed bottom 14 and an open top 16 and an intermediate sidewall 18 therebetween. The intermediate sidewall 18 has a lower end 20 and a rigid upper end 22. A circular flange 24 is secured to the rigid upper end 22 of the intermediate sidewall 18. The circular flange 24 has an inner edge 26, an outer edge 28, and an intermediate extent 30 therebetween. A circular recess 32 is formed upwardly within the intermediate extent 30 of the circular flange 24. The cylindrical screened container 12 is made of a nylon mesh with a pore size of between 0.05 millimeters to 5.0 millimeters. The nylon mesh functions to prevent food particles and other objects from entering into the drain valve, pump and washer arms. Although nylon is specified, it is within the scope of the present invention to employ other materials. For example, other plastics or stainless steel or a wide variety of other equivalent materials could also be used. A flexible magnetic element 34 is secured within the circular recess 32 formed within the intermediate extent 30 of the circular flange 24 of the cylindrical screened container 12. The flexible magnetic element 34 functions to seal the circular screened container 12 to the floor of a dishwasher.

The magnetic element designed to seal the unit to the floor of the dishwasher is but one way to secure the removable scrap trap to the dishwasher. The invention could also snap into place, screw into place, or be secured in any other feasible manner.

A plastic handle 36 is secured to the rigid upper end 22 of the cylindrical screened container 12. The plastic handle 36 must be strongly secured to the cylindrical screened container 12 most likely with a two part epoxy resin or another bonding glue. The plastic handle 36 functions to allow the cylindrical screened container 12 to be removed from the water passageway leading to the pump.

The present invention is designed to improve the reliability of automatic dishwashers. One problem often encountered with these machines is that food scraps, toothpicks, and the like often get through the screen and pass into the drain valve, the pump, or the washer arms.

When this happens, the effectiveness of the dishwasher may be diminished or it may stop working altogether. It is for this reason that manufacturers recommend rinsing dishes before putting them in the dishwasher. In essence, users must wash their dishes twice, which not only takes more time, but uses a lot more water.

The present invention offers a better way. It features an extremely fine nylon screen capable of stopping even toothpicks and small bits of food. The screen is located in one of the front corners of the dishwasher in order to be accessible to users for periodic cleaning. A magnetic flange on the bottom self-seals the unit to the floor of the dishwasher. A handle across the top makes the present invention easy to remove.

A dishwasher made for this unit must be deigned so that all water drains through this trap. In that way, effective screening of solid particles is accomplished before it reaches parts of the dishwasher that might be damaged by food and other small items.

Users of dishwashers equipped with the present invention will find their lives simplified because there will no longer be a need to rinse dishes before washing them. Others who refuse to pre-rinse will find that their dishwasher runs more smoothly with fewer breakdowns.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A new and improved removable scrap trap for dishwashers comprising, in combination:

a cylindrical screened container having a closed bottom and an open top and an intermediate sidewall therebetween, the intermediate sidewall having a lower end and a rigid upper end, a circular flange secured to the rigid upper end of the intermediate sidewall, the circular flange having an inner edge, an outer edge, and an intermediate extent therebetween, a circular recess formed upwardly within the intermediate extent of the circular flange, the cylindrical screened container being made of a nylon mesh with a pore size of between 0.05 millimeters to 5.0 millimeters and functioning to prevent food particles and other objects from entering into the drain valve, pump and washer arms;

a flexible magnetic element secured within the circular recess formed within the intermediate extent of the circular flange of the cylindrical screened container, the magnetic element functioning to seal the circular screened container to the floor of a dishwasher; and a plastic handle secured to the rigid upper end of the intermediate sidewall of the cylindrical screened container, the plastic handle functioning to allow the cylindrical screened container to be removed from the water passageway leading to the pump.

* * * * *